US008905250B2

(12) United States Patent
Stander

(10) Patent No.: US 8,905,250 B2
(45) Date of Patent: Dec. 9, 2014

(54) POWER AND CONTROL FOR WIRELESS ANTI-TWO BLOCK SYSTEM

(75) Inventor: Martin R. Stander, Greencastle, PA (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 828 days.

(21) Appl. No.: 12/762,186

(22) Filed: Apr. 16, 2010

(65) Prior Publication Data

US 2011/0253662 A1 Oct. 20, 2011

(51) Int. Cl.

| | |
|---|---|
| ***B66C 23/88*** | (2006.01) |
| ***B66C 13/14*** | (2006.01) |
| ***B66C 15/06*** | (2006.01) |
| ***B66C 13/50*** | (2006.01) |
| ***B66C 13/44*** | (2006.01) |

(52) U.S. Cl.

CPC ..... *B66C 15/065* (2013.01); *B66C 13/14* (2013.01); *B66C 13/50* (2013.01); *B66C 23/88* (2013.01); *B66C 13/44* (2013.01)

USPC ..... 212/281; 212/280

(58) Field of Classification Search

USPC ..... 212/180, 181, 280, 281

See application file for complete search history.

(56) References Cited

U.S. PATENT DOCUMENTS

| | | | | |
|---|---|---|---|---|
| 2,634,405 | A | 3/1949 | Van Stone et al. | |
| 2,772,794 | A | 12/1956 | Cramer et al. | |
| 2,789,282 | A * | 4/1957 | Winters | 340/660 |
| 2,925,923 | A | 2/1960 | Preston | |
| 3,837,698 | A | 9/1974 | Foster | |
| 3,922,789 | A | 12/1975 | Sarrell | |
| 4,573,725 | A | 3/1986 | Griffiths | |
| 4,804,095 | A | 2/1989 | Rohr et al. | |
| 5,071,184 | A | 12/1991 | Dessaux | |
| 6,343,703 | B1 | 2/2002 | Fleagle et al. | |
| 6,994,223 | B1 * | 2/2006 | Edgar et al. | 212/270 |
| 7,345,441 | B2 * | 3/2008 | Yoshimatsu | 318/372 |
| 2005/0017513 | A1 | 1/2005 | Sipp | |
| 2011/0253662 | A1 | 10/2011 | Stander | |
| 2011/0303886 | A1 | 12/2011 | Cryer et al. | |

FOREIGN PATENT DOCUMENTS

| | | |
|---|---|---|
| CN | 2871473 Y | 2/2007 |
| DE | 299 06 525 | 9/1999 |
| DE | 10 2008 032603 | 1/2010 |
| EP | 0 921 089 | 6/1999 |
| JP | 2011-102168 A | 5/2011 |
| WO | WO 2009/089628 | 7/2009 |

* cited by examiner

*Primary Examiner* — Sang Kim
*Assistant Examiner* — Nataniel Adams
(74) *Attorney, Agent, or Firm* — John C. Bacoch; Brinks Gilson & Lione

(57) ABSTRACT

A power generator is associated with a crane boom at or near the tip of the boom. The generator responds to movement of the lifting cable to initiate the transmission of a signal to a crane controller. The signal serves as a start-up or a wake-up signal to the crane controller which may then immediately analyze operation of, for example, an anti-two block device associated with the boom tip. The crane controller may then control the operation of the crane in accordance with signals received from the anti-two block device or immediately identify malfunctions of the anti-two block device and control the crane operations accordingly.

17 Claims, 4 Drawing Sheets

POWER AND CONTROL FOR WIRELESS ANTI-TWO BLOCK SYSTEM

FIELD OF THE INVENTION

The invention relates to methods and apparatus for powering anti-two block devices in lifting cranes and for integrating anti-two block devices and controls in an advantageous manner into the overall control system for a crane.

BACKGROUND OF THE INVENTION

Operation of lifting cranes requires careful attention and control in order to avoid various undesirable developments and conditions. One condition generally to be avoided during operation of a lifting crane is what is known as two blocking. This occurs when the lifting hook or the lifting hook block of a crane is raised to the point that it comes into contact with the boom nose sheave or some other portion of the boom nose. Such contact can result in stresses which are too great for various structural elements of the crane, or may result in unstable operation.

It is known to provide cranes with anti-two blocking devices which guard against such a condition and/or warn a crane operator of actual or impending two blocking. A typical such device may comprise a mechanical switch which remains in a first position during general operation of the crane, but is moved into a second position by contact with the hook block if the hook block approaches the boom nose too closely. A signal resulting from the change in state of the switch can be used to warn an operator of possible two blocking, or the signal may be provided to a control system for managing operation of the crane automatically. Non-contact type anti-two block sensors are also known. Such sensors detect the approach of the lifting hook block to the boom nose by non-contact means, such as use of infrared technology.

As noted, anti-two blocking devices and switches are normally located proximate the boom nose of a lifting crane. As a result, power for the device typically must be run, via a wire and/or conduit, from a power source at the base of the crane, along the crane boom, to the region of the boom nose in order to provide operating power. In cranes comprising extensible booms, this requires complex linkages, conduits, or other structures to accommodate the fact that the power must run along a path that is variable in length, and between elements which may be articulated with respect to each other in various ways. Such arrangements can be somewhat costly and difficult to construct and maintain.

It is known, in connection with anti-two block devices, to use a storage battery located proximate to the boom nose for providing operating current to the device. Batteries have an inherent shortcoming in that they have a finite service life. Accordingly, reliance upon a battery to power, an anti-two block device presents a risk that a sensor of the anti-two block device will simply not have operating power when its operation is needed. Additionally, upon startup of a crane, it may take some amount of time before it may be recognized if the anti-two block sensor is functioning properly or if it is not functioning due to lack of operating current, or for any other reason. Should this occur, and if the crane is operated during any period of time when the anti-two block sensor is not functioning properly, it is possible for the crane to two-block without warning or control.

SUMMARY OF THE INVENTION

The present invention overcomes such shortcomings in several ways. In accordance with the invention, a reliable and convenient source is provided for charging batteries during normal use of the crane. Such source of power can also be used to power the anti-two block sensor directly, as necessary or desirable. A feature of an apparatus according to the invention is that it provides a signal upon initiation of operation of a crane, to alert the crane operator and/or to signal a control system for the crane that operation has commenced and that a determination must be made whether the anti-two block detection means is functioning properly. This arrangement avoids a situation, as described above, wherein the crane may operate for an indeterminate period before it might be recognized that an appropriate signal may not be available because of a malfunction or a lack of operating current to an anti-two block sensor.

The invention provides an apparatus and a method which facilitates control of operation of a crane in a matter which more reliably avoids the possibly of two-blocking during crane operation, especially at the point of startup of the crane.

The invention pertains to a crane which includes an anti-two block sensor and an anti-two block control device proximate to the boom tip of the crane. A signaling device is associated with the anti-two block sensor. A power generator is provided, the generator being responsive to a movement of a lifting cable of the crane, and/or responsive to any action or movement of the crane that causes rotation of a sheave engaging the lifting cable, for generating power. The power generator provides power to the anti-two block sensor, to the anti-two block control device and to the signaling device. The crane further includes a crane operation controller. According to the invention, the crane operation controller is responsive to the anti-two block sensor for preventing operation of the crane in a manner that would result in two blocking. The signaling device provides an initiation signal to the crane operation controller in response the commencement of operation of the power generator to thereby actuate the crane operation controller to monitor for operation of, and signals from, the anti-two block sensor.

The invention also relates to a method for operating a crane which includes generating power responsive to movement of a lifting cable, generating an initiation signal in response to the power generation, providing an initiation signal to a controller for the crane, and operating the crane controller in response to the initiation signal to monitor a condition of the crane. Such condition might be, for example, the condition of an anti-two block sensor associated with the crane.

BRIEF DESCRIPTION OF THE DRAWINGS

The invention will be best understood upon consideration of the following description of a preferred embodiment, considered together with the accompanying drawings in which.

DETAILED DESCRIPTION OF A PREFERRED EMBODIMENT

Figure 1A:
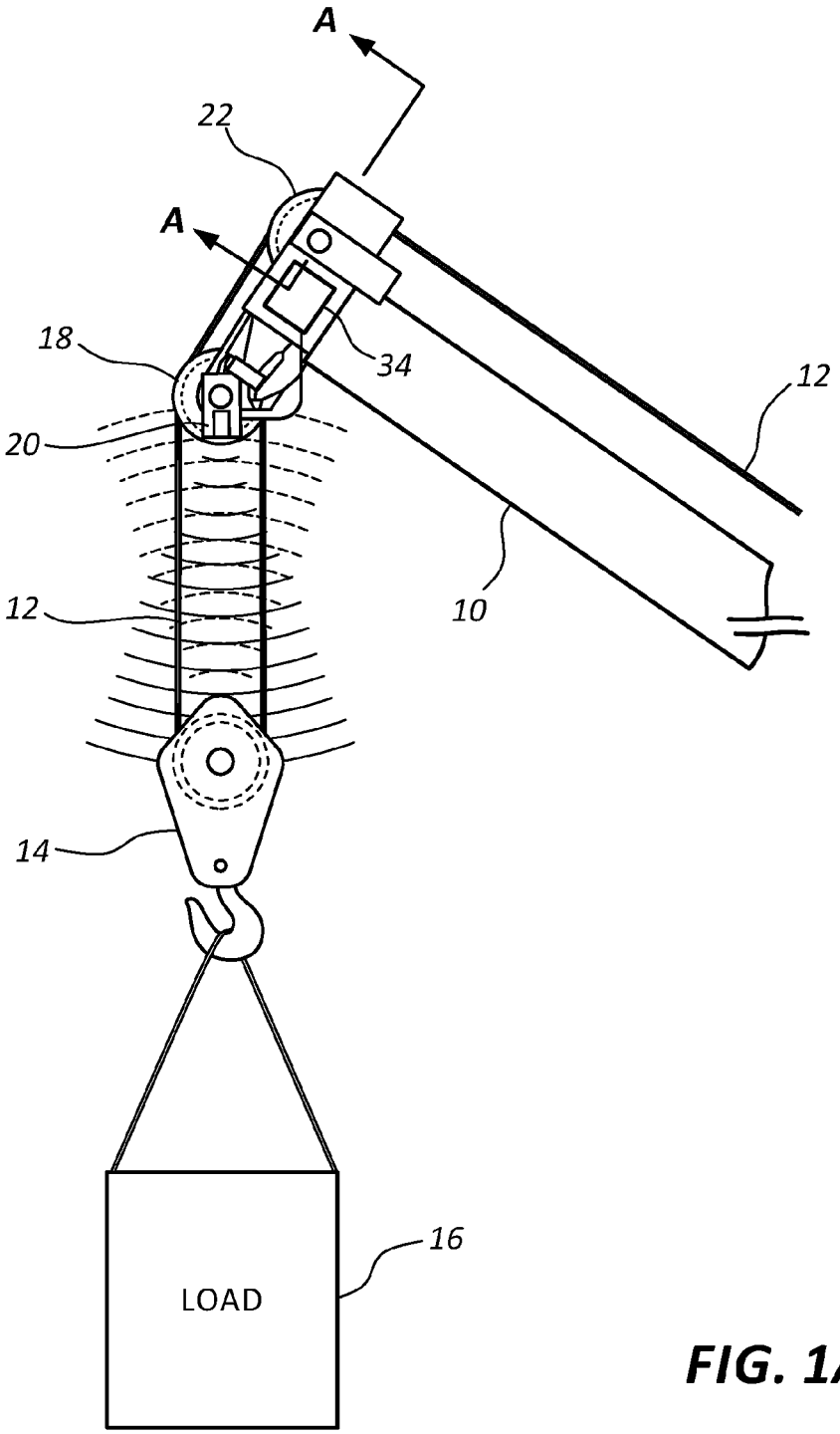
FIGS. 1A and 1B illustrate the boom tip of a crane, supporting a load, and comprising an anti-two block sensor and other structural components according to the invention.

Referring to FIG. 1A, there is illustrated the upper-most end or tip portion of a crane jib or boom 10. As is well known, the crane includes a cable 12 for lifting loads. The cable supports a hook block 14 which supports a load 16, which may be raised or lowered as necessary or appropriate.

As the cable 12 is paid out or reeled in by the crane, hook block 14 and load 16 are lowered or raised. During operation of the crane, it is possible that certain operations could occur which could raise hook block 14 to an extent that it would collide with or come in contact with cable sheave 18 associated with the boom tip. That is a normally undesirable condition commonly known as two-blocking.

For example, two-blocking could occur if cable 12 is reeled in too much by the crane, raising hook block to the point where it would contact cable sheave 18. The same could occur if the boom was extended telescopically by some amount without also paying out enough cable 12 to account for the greater length of the boom. It is also possible that two-blocking could occur if the boom is lowered (moved to an angular position closer to the horizontal) without paying out enough cable to account for what may be an increased total distance between the boom tip and the point at which the cable meets the base of the crane.

In view of the possibility of two-blocking, it is well known to include an anti-two block device in a crane. Generally, an anti-two block device includes a sensor for identifying or sensing a situation wherein the hook block 14 approaches to closely to sheave 18 or other elements associated with the tip of the boom. As noted above, such devices may be mechanical switches which are actuated by, for example, contact with hook block 14 if it approaches too closely to the boom tip.

In the exemplary embodiment illustrated in FIG. 1A, an anti-two block sensor 20 is mounted near the tip of the boom. In this embodiment, sensor 20 is mounted adjacent the lowermost portion of the boom tip, generally adjacent sheave 18. Anti-two block sensor 20, in this embodiment, is a non-contact type of sensor that senses the approach of hook block 14 by, for example, acoustic wave energy, infrared sensors, or other known methods.

According to the invention, the crane further includes a power generation device that is actuated by movement of the lifting cable in relation to other portions of the crane. In one example of the invention, power generation means are associated with cable sheave 22 positioned at the tip of the boom. This position is not limiting, however. The power generation means could be associated with cable sheave 18 or another element responsive to cable movement. It is most convenient, in accordance with the present invention, that the power generation means be located generally proximate to the boom tip.

Figure 2:
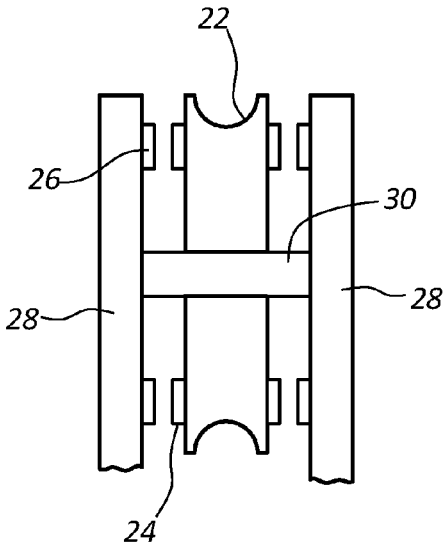
FIG. 2 is a partial sectional view along line AA of FIG. 1A, depicting an example of a power generator component according to the invention.

A first embodiment of the power generation means is illustrated in FIG. 2. As shown in FIG. 2, a plurality of permanent magnets 24 may be mounted on one of both faces of sheave 22. A plurality of electromagnetic coils 26 are mounted on supports 28 for sheave 22, generally opposite the permanent magnets 24. Magnets 24 are arranged in a regular pattern on one or both faces of sheave 22 rotate with sheave 22 about axle 30. Coils 26 pick up the flux from magnets 24, thereby generating power. Sheave 22 will be caused to rotate, for example, if the lifting cable is reeled in or paid out, if the boom is extended or retracted telescopically without a commensurate amount of additional cable being paid out or reeled in, or if the boom is raised or lowered (from a first position either in an upward direction toward a more vertical position or in a downward direction toward a more horizontal position).

Figure 3:
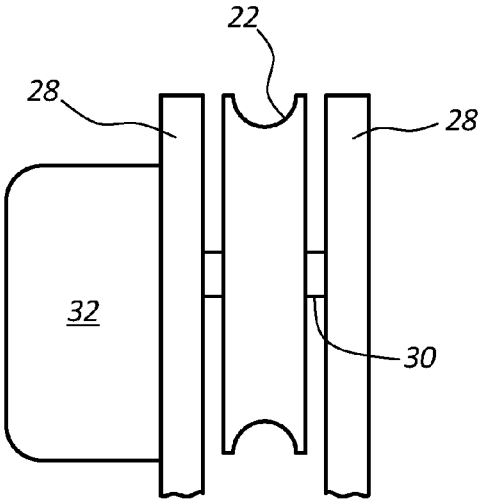
FIG. 3 is an illustration of another example of a power generating component according to the invention.

FIG. 3 illustrates an alternate approach to providing a power generation means in accordance with the invention. As illustrated in FIG. 3, a self-contained generator 32 may be mounted, for example, on support 28 and driven via axle 30 which supports sheave 22. Generator 32 may be driven with or without intermediate gearing to selectively control the relative speed of rotation of generator 32 as compared with the speed of rotation of sheave 22. Generator 32 could be driven by sheave 18, for example.

Anti-two block sensor 20 and the power generation means of the invention are connected to a circuitry module 34. Circuitry module 34 contains various components and controls, as will be described in greater detail hereinafter. Module 34 is conveniently supported near the tip of the boom. In the exemplary embodiment shown in FIGS. 1A, module 34 is mounted on a side face of the boom. This location is only exemplary, however, and not limiting.

Figure 4:
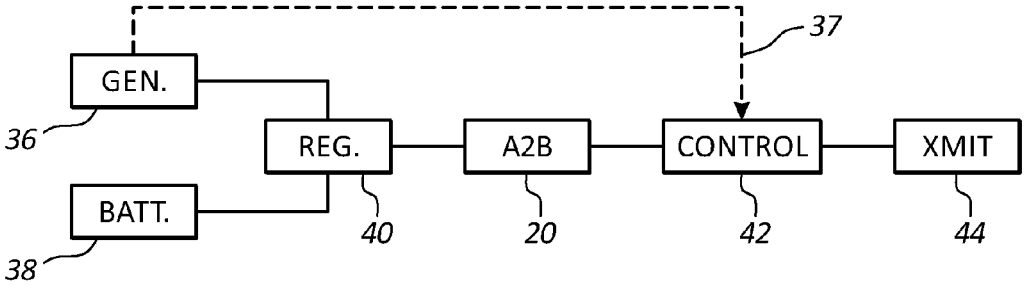
FIG. 4 is a schematic illustration of a combination of components that might be advantageously positioned proximate a boom tip of a crane in accordance with the present invention.

FIG. 4 is a schematic illustration of the components and controls which, according to the invention, are advantageously and conveniently located in the vicinity of the boom tip of a crane. As illustrated in FIG. 4, these components first include a power generator 36. This power generator comprises, generally, power generation means as described above with reference to FIG. 2 or FIG. 3, or a similar or equivalent device. A battery 38 is also provided. Anti-two block sensor 20 is connected to both the generator and the battery via a power regulator 40. Power regulator 40 serves to control the flow of current during operation of the device.

Particularly, when generator 36 is operational as a result of cable movement and battery 38 requires charging, power regulator controls the flow of current to battery 38 to thereby charge the battery. Regulator 40 also controls the flow of power to anti-two block sensor 20, enabling such flow of current in the event that the battery is not adequately powering the sensor 20 and/or the battery does not need charging.

Anti-two block sensor 20 provides signals to a control device 42. A device according to the invention also includes a transmitter 44 which is responsive to control 42, in appropriate circumstances, to transmit wireless signals. Transmitter 44 transmits signals representing the state of anti-two block sensor 20, as well as certain start-up or wake-up signals, as discussed in greater detail below.

Figure 5:
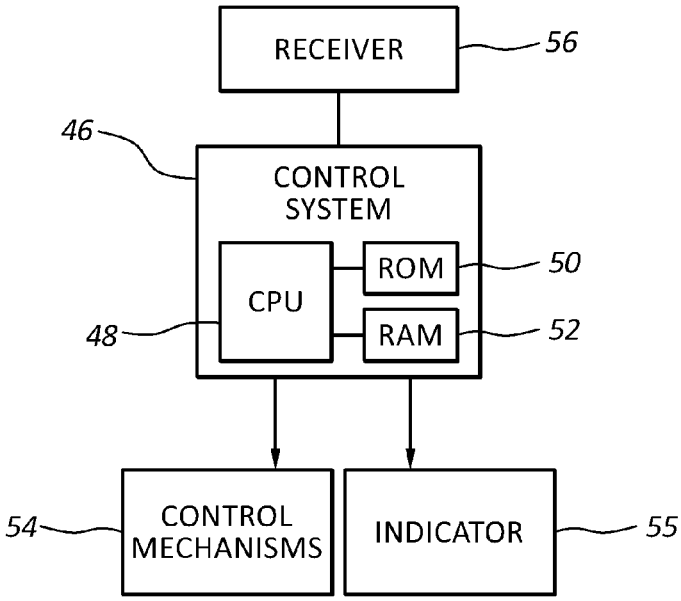
FIG. 5 is a schematic illustration of a crane operation controller in accordance with the present invention.

Operation of the invention will be understood with further reference to FIG. 5. FIG. 5 is a schematic illustration of a crane controller 46 which is provided for general operation and control of the crane and its functions. Crane controller 46 is normally located in or near the cab of the crane, at the base of the crane or in some similar location. Controller 46 may typically include a CPU 48, a ROM 50, a RAM 52 and/or other circuitry, devices and software for managing computer controlled operation of a crane in accordance with appropriate programming. The illustrated elements are typical of a crane control system, are presented as merely exemplary, and not as limiting of the present invention.

In operation of the crane, the crane control provides output signals to a variety of crane control mechanisms generally designated by reference numeral 54. The crane control mechanisms may comprise, generally, switches, servos, and other controls and devices for actuating or halting operations of various parts and functions of the crane. Such operations include, for example, cable reeling, boom extension, boom up and boom down operations, and a variety of other functions associated with crane operation. Cable reeling, boom extension, and boom up/down operations are those which could cause two-blocking as discussed above.

According to the invention, a receiver 56 is associated with crane controller 46. Receiver 56 receives wireless signals from transmitter 44 associated with the apparatus located at the boom tip. Wireless communication between the components at the tip of the boom and the crane controller at the base of the boom is advantageous in that it eliminates the need for any physical connectivity between devices in those respective locations.

As discussed above, in a typical prior art crane, an anti-two block device might be provided at the boom tip, powered by a battery in order to avoid the need for physical connectivity between the boom tip and the crane controller at the base of the crane. Upon startup of the crane, the crane controller receives input from various sources, sensors, etc. located in various parts of the crane which provide information to the controller about the physical configuration of the crane, the position of various elements, the magnitude and direction of any loads upon the crane, etc. A signal from the anti-two block device is one of the many signals that would be called for in order to provide adequate information to the crane controller.

However, in the event that there is a malfunction of the anti-two block device, or if there is no power being provided to the anti-two block device because of a dead battery or for other reasons, the controller may not recognize the existence of that malfunction for some period of time. As a result, the crane might commence operation without recognition of the malfunction. This creates a possibility that two-blocking could occur without warning, which would be highly undesirable. The present invention overcomes this disadvantage.

In accordance with the invention, upon startup of the crane and any paying out or reeling in of the lifting cable 12, or any other operation of the crane that results in rotation of sheave 22, as discussed above, operation of the power generating means 36 commences immediately and power generator 36 reliably generates power. This immediate and reliable power upon cable movement is utilized to initiate and create a start-up or wake-up signal that is transmitted by transmitter 44, as illustrated in FIG. 4. The initiation of the startup or wakeup signal might be the result of a command sequence initiated at control 42, in response to power from generator 36, as illustrated schematically at 37 in FIG. 4.

The start-up or wake-up signal emitted by transmitter 44 is received at receiver 56 associated with the crane controller. As a result, crane controller 46 is informed immediately and reliably that cable movement in relation to the boom tip has commenced. This signal of the initiation of cable movement serves as an alert to crane controller 46 that it must receive an appropriate signal from anti-two block sensor 20.

The possible situations that could be sensed at crane controller 46, at that instant of time when the start-up or wake-up signal is received at receiver 56, include a first condition or scenario wherein anti-two block sensor 20 is operational, and provides a signal to indicate that two-blocking has not occurred (that is, hook block 14 is not undesirably close to or contacting cable sheave 18). Upon receiving such a signal, crane control 46 could continue operation of the control in a normal manner.

A second possible scenario would be a receipt of a signal that anti-two block sensor 20 is operational and which indicates that two-blocking has occurred (hook block 14 is touching or undesirably close to sheave 18). In that event, the crane controller 46 could actuate appropriate control mechanisms 54 to disable functions that cause or would tend to cause two-blocking. As noted above, the functions to be disabled would include, for example, cable reeling in, boom extension, and boom lowering.

A third possible scenario is that, upon receipt of the startup or wakeup signal at receiver 56, no additional signal whatsoever is received from anti-two block sensor 20. This absence of information may be relied upon by crane controller 46 to also disable functions of the crane, thus avoiding the possibility of operation of the crane in a manner which, perhaps, would cause undesirable two-blocking In the second and third scenarios discussed in the immediately preceding paragraphs, the crane controller could conveniently be programmed to actuate an indicator 55. This could be a light, buzzer or other device to alert the crane operator that an undesirable condition exists.

Thus, the present invention enables the crane controller to perform functions beyond merely permitting or prohibiting certain crane operations in response to signals from an anti-two block sensor. The invention also provides a capacity for a crane to analyze operation of the anti-two block sensing system for faults and malfunctions, and enables the crane controller to disable crane functions, as necessary, to avoid undesirable conditions in the event of such a malfunction. The invention thus provides the function and capability that is not present in the prior art devices, namely, an ability to control crane operation and prevent undesirable occurrences not only when signaled to do so, but when the crane controller lacks information to which it might respond.

The invention enables a crane controller to verify when cable movement has commenced, and to then immediately either confirm proper operation of the crane, or control the crane immediately to avoid improper operation when such improper operation is signaled or when sufficient information about the condition of the crane is not available.

Figure 1B:
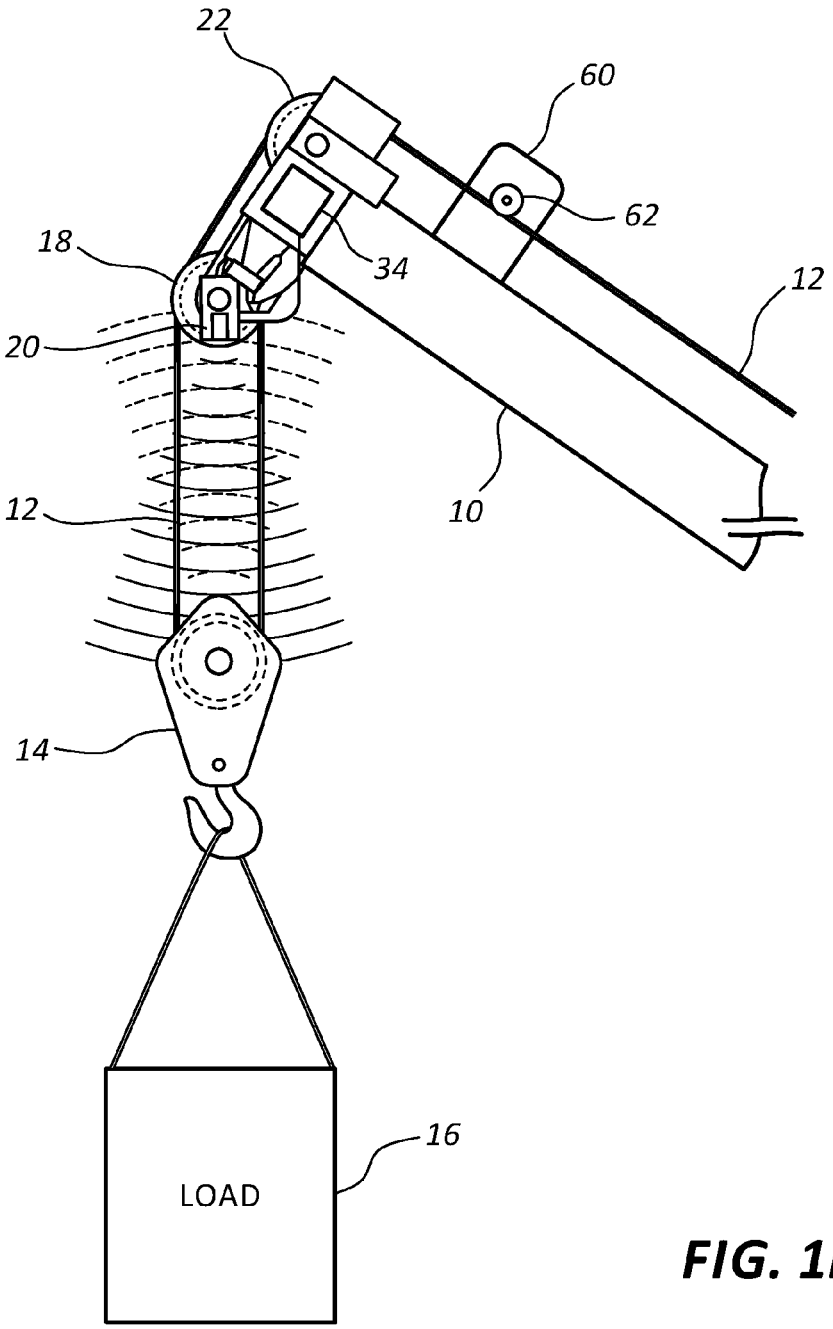

The invention has been described with reference to certain preferred embodiments. It is not limited to these embodiments, however. For example, power generation can be accomplished in response to cable movement using devices other than those illustrated in FIGS. 2 and 3. In one example, illustrated in FIG. 1B, a generator 60 may be mounted on the boom 10 generally along the path of cable 12. Generator 60 may be driven, for example, by a friction wheel 62 which engages the lifting cable. Such an arrangement might be particularly advantageous, for example, to easily retrofit existing cranes with devices according to the present invention.

The power generating means according to the invention may be advantageously used to power other devices that are mounted proximate the head or tip of the boom. These might include devices for sensing wind direction and speed, devices for sensing angle of elevation of the boom, devices for sensing boom length, devices for measuring the load on a crane hook or other crane element, or other conditions pertinent to boom operation, or for powering devices other than sensors.

Thus, the invention is not limited to the embodiments and details shown, but includes all variations and features within the scope of the appended claims.

The invention claimed is:

1. A crane comprising:

an anti-two-block sensor connected to an anti-two-block control;

a transmitter located proximate a boom tip of the crane and coupled with the anti-two-block control;

a power generating device directly connected to said anti-two-block control, and configured to provide power to said anti-two-block sensor and said anti-two-block control, said power generating device being responsive to movement of a lifting cable of the crane for generating power;

wherein said anti-two-block control is configured to generate a command sequence responsive to commencement of power flowing out of the power generating device, and wherein said transmitter is configured to generate an initiation signal responsive to said command sequence;

a crane operation controller for controlling operations of said crane, said crane operation controller being responsive to said initiation signal for preventing operation of the crane in a manner that would result in two-blocking;

wherein said transmitter wirelessly transmits the initiation signal to said crane operation controller in response to commencement of operation of said power generating device to actuate said crane operation controller to monitor and respond to control signals from said anti-two-block sensor in operation of said crane.

2. A crane as in claim 1, wherein the lifting cable of the crane passes over a sheave at the boom tip, and said power generating device is responsive to rotation of said sheave.

3. A crane as in claim 2, said power generating device comprising a generator driven by said sheave.

4. A crane as in claim 1, wherein said crane operation controller is positioned at a location selected from the group consisting of within a cab of the crane; adjacent the cab; and at a base of the crane.

5. A crane as in claim 4, wherein said signaling device also communicates anti-two block signals wirelessly with said crane operation controller.

6. A crane as in claim 1, wherein said anti-two-block sensor and said anti-two-block control device communicate wirelessly with said crane operation controller.

7. A method for operating a crane, comprising:

generating power responsive to movement of a lifting cable of the crane by a power generating device;

powering an anti-two-block sensor and anti-two-block control with said power generating device, in which said power generating device is directly connected to the anti-two-block control;

generating a command sequence with the anti-two-block control device responsive to power flowing out of the power generating device as a direct result of commencement of the movement of the lifting cable;

generating an initiation signal by a transmitter in response to receipt of the command sequence from the anti-two-block control;

wirelessly transmitting said initiation signal to a controller for the crane; and operating said controller in response to said initiation signal to monitor a condition of the crane as detected by the anti-two-block sensor.

8. A method for operating a crane as in claim 7, comprising generating power by utilizing movement of the cable of the crane to drive a generator.

9. A method for operating a crane as in claim 7, further comprising providing said generated power to a device for determining the condition monitored by the controller.

10. A method for operating a crane as in claim 9, further comprising mounting the anti-two-block sensor proximate a boom tip of the crane.

11. A method for operating a crane as in claim 7, comprising transmitting anti-two block signals wirelessly from the anti-two-block sensor to the controller.

12. A method for operating a crane as in claim 10, comprising transmitting said initiation signal wirelessly from the anti-two-block sensor to the controller.

13. The crane of claim 1, wherein said power generating device comprises a magnet attached to the sheave and an electromagnetic coil attached to a sheave support that holds the sheave, where an electrical current is induced in the electromagnetic coil as the sheave rotates the magnet past the electromagnetic coil.

14. A crane comprising:

a signaling device located on a crane and operable to monitor a condition of the crane, said signaling device including an anti-two-block sensor;

a power generating device responsive to movement of a lifting cable of the crane, said power generating device delivering power to said signaling device;

a battery connected to said anti-two-block device and configured to store power generated by said power generating device;

a power regulator connected to the power generating device, to said battery and to said anti-two-block sensor, said power regulator configured to separately control flow of power between being sent to said battery and being sent to said signaling device, such that current flows to said anti-two-block sensor directly from said power generating device when said battery does not provide adequate power or when said battery is fully charged;

a crane operation controller for controlling operations of said crane, said crane operation controller being responsive to said signaling device;

wherein said signaling device wirelessly transmits an initiation signal to said crane operation controller in response to commencement of operation of said power generating device, to actuate said crane operation controller to monitor and respond to control signals.

15. The crane of claim 14, wherein the power generating device comprises a friction wheel engaged with the lifting cable.

16. A crane as in claim 14, wherein said crane operation controller is located on the crane at a base of a boom, wherein said signaling device communicates wirelessly and bidirectionally with said crane operation controller.

17. A crane as in claim 14, wherein said power generating device comprises:

a magnet attached to a sheave in which said lifting cable travels;

an electromagnet coil attached to a sheave support that holds said sheave, where electrical current is induced in said electromagnetic coil as said sheave rotates said magnet past said electromagnetic coil.

* * * * *